US011845482B2

(12) United States Patent
Ueda et al.

(10) Patent No.: US 11,845,482 B2
(45) Date of Patent: Dec. 19, 2023

(54) OBSTACLE DETECTION DEVICE AND OBSTACLE DETECTION METHOD

(71) Applicant: Mitsubishi Electric Corporation, Tokyo (JP)

(72) Inventors: Naoki Ueda, Tokyo (JP); Akira Nakanishi, Tokyo (JP); Yoshitsugu Sawa, Tokyo (JP); Emiko Kurata, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 808 days.

(21) Appl. No.: 16/966,931

(22) PCT Filed: Feb. 8, 2018

(86) PCT No.: PCT/JP2018/004329
§ 371 (c)(1),
(2) Date: Aug. 3, 2020

(87) PCT Pub. No.: WO2019/155569
PCT Pub. Date: Aug. 15, 2019

(65) Prior Publication Data

US 2021/0046959 A1 Feb. 18, 2021

(51) Int. Cl.
*B61L 23/04* (2006.01)
*B61L 25/02* (2006.01)
(Continued)

(52) U.S. Cl.
CPC ..... *B61L 23/041* (2013.01); *B61L 25/025* (2013.01); *B61L 27/04* (2013.01); *B61L 15/0072* (2013.01); *B61L 2201/00* (2013.01)

(58) Field of Classification Search
CPC ..... B61L 23/041; B61L 25/025; B61L 27/04; B61L 2201/00; B61L 15/0072
(Continued)

(56) References Cited

U.S. PATENT DOCUMENTS

2019/0392225 A1* 12/2019 Chihara ..... B61L 15/0081
2020/0307661 A1* 10/2020 Hania ..... G06T 7/181

FOREIGN PATENT DOCUMENTS

CN 105431864 A * 3/2016 ..... B61L 23/041
CN 107253485 A * 10/2017 ..... B61L 23/041
(Continued)

OTHER PUBLICATIONS

International Search Report (with English Translation) and Written Opinion issued in corresponding International Patent Application No. PCT/JP2018/004329, 9 pages (dated May 15, 2018).
(Continued)

*Primary Examiner* — S. Joseph Morano
*Assistant Examiner* — James William Jones
(74) *Attorney, Agent, or Firm* — BUCHANAN INGERSOLL & ROONEY PC

(57) ABSTRACT

An obstacle detection device installed in a train includes: a sensor that monitors surroundings of the train and generates a range image that is a result of monitoring; a storage unit that stores map information including position information of structures installed along a railroad track on which the train travels; a correction unit that corrects, using the range image acquired from the sensor and the map information stored in the storage unit, first train position information that is information acquired from a train control device and indicates a position of the train, and outputs second train position information that is a result of correction; and a monitoring condition determination unit that determines a monitoring range of the sensor using the second train position information and the map information.

14 Claims, 6 Drawing Sheets

(51) Int. Cl.
*B61L 27/04* (2006.01)
*B61L 15/00* (2006.01)

(58) Field of Classification Search
USPC ..... 246/122 R
See application file for complete search history.

(56) References Cited

FOREIGN PATENT DOCUMENTS

| | | | | | |
|---|---|---|---|---|---|
| CN | 108248640 | A | * | 7/2018 | ..... B61L 23/14 |
| DE | 102006015036 | A1 | * | 10/2007 | ..... B61K 9/08 |
| EP | 3138754 | A1 | * | 3/2017 | ..... B61K 9/08 |
| EP | 3275764 | A1 | * | 1/2018 | ..... B61L 23/041 |
| JP | 2566270 | B2 | | 8/1989 | |
| JP | 2000090393 | A | | 3/2000 | |
| JP | 2000351371 | A | | 12/2000 | |
| JP | 2001310733 | A | | 11/2001 | |
| JP | 2015114126 | A | | 6/2015 | |
| WO | 2007032427 | A1 | | 3/2007 | |
| WO | WO-2016114088 | A1 | * | 7/2016 | ..... B60L 15/20 |
| WO | WO-2018158712 | A1 | * | 9/2018 | ..... B61L 23/041 |

OTHER PUBLICATIONS

Office Action dated Jun. 19, 2021, for corresponding Indian Patent Application No. 202027032998, 5 pages.
Office Action dated Sep. 15, 2020, issued in corresponding Japanese Patent Application No. 2019570214, 5 pages including 3 pages of English translation.

* cited by examiner

OBSTACLE DETECTION DEVICE AND OBSTACLE DETECTION METHOD

FIELD

The present invention relates to an obstacle detection device and an obstacle detection method for detecting an obstacle on a route of a train.

BACKGROUND

Patent Literature 1 discloses that a vehicle traveling along a laid groove-shaped track includes an obstacle detection means such as a stereo optical system and a laser radar transmission and reception device, and detects an obstacle in a surrounding using the obstacle detection means. The vehicle described in Patent Literature 1 is a so-called automobile that travels on a general road surface with its own tires.

CITATION LIST

Patent Literature

Patent Literature 1: Japanese Patent Application Laid-open No. 2001-310733

SUMMARY

Technical Problem

By installing the obstacle detection means described in Patent Literature 1 in a train, the train can detect an obstacle on the route. However, a train traveling on rails with wheels has a longer braking distance than an automobile traveling on a general road surface with tires. When the obstacle detection means described in Patent Literature 1 is installed in a train, a range to be monitored must be extended farther at a longer distance than when the means is installed in an automobile, according to the longer braking distance. For this reason, there has been a problem that the amount of calculation is larger than when it is installed in an automobile. The obstacle detection means described in Patent Literature 1 can reduce the amount of calculation by lowering the resolution of an image. However, lowering the resolution of an image causes a deterioration in obstacle detection accuracy, which has also been problematic.

The present invention has been made in view of the above circumstances, and an object thereof is to provide an obstacle detection device capable of detecting an obstacle without deteriorating the accuracy while reducing the amount of calculation.

Solution to Problem

In order to solve the above-mentioned problems and achieve the object, the present invention provides an obstacle detection device installed in a train, the obstacle detection device comprising: a sensor to monitor surroundings of the train and generate a range image that is a result of monitoring; a storage unit to store map information including position information of structures installed along a railroad track on which the train travels; a correction unit to correct, using the range image acquired from the sensor and the map information stored in the storage unit, first train position information that is information acquired from a train control device and indicates a position of the train, and to output second train position information that is a result of correction; and a monitoring condition determination unit to determine a monitoring range of the sensor using the second train position information and the map information.

Advantageous Effects of Invention

According to the present invention, the obstacle detection device can achieve the effect of detecting an obstacle without deteriorating the accuracy while reducing the amount of calculation.

DESCRIPTION OF EMBODIMENTS

Hereinafter, an obstacle detection device and an obstacle detection method according to embodiments of the present invention will be described in detail with reference to the drawings. The present invention is not necessarily limited by these embodiments.

First Embodiment

Figure 1:
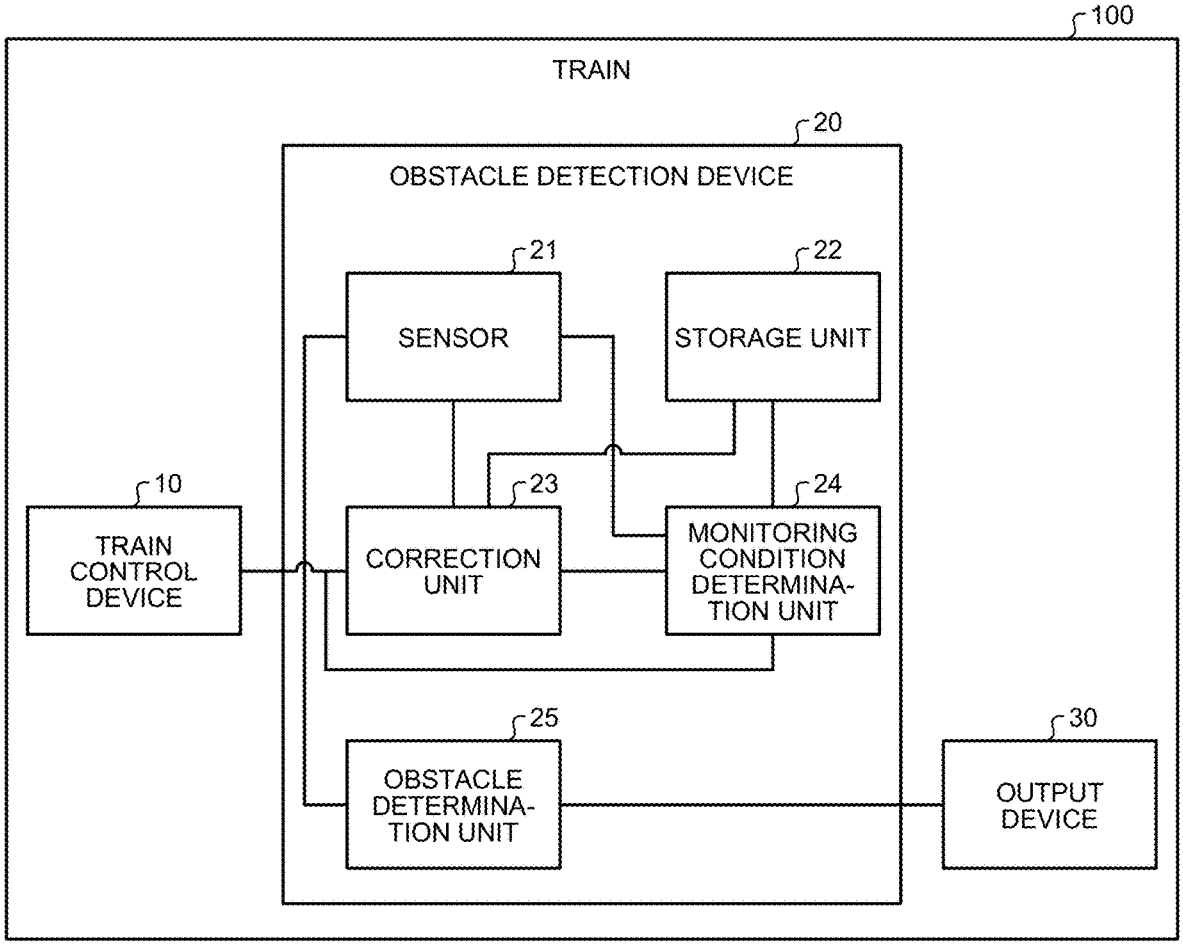
FIG. 1 is a diagram illustrating an exemplary configuration of an obstacle detection device according to a first embodiment.

FIG. 1 is a block diagram illustrating an exemplary configuration of an obstacle detection device 20 according to the first embodiment of the present invention. The obstacle detection device 20 is a device that is installed in a train 100 and detects an obstacle located in a traveling direction of the train 100. The obstacle detection device 20 is connected to a train control device 10 and an output device 30. The train control device 10 and the output device 30 are also devices installed in the train 100. The obstacle detection device 20 includes a sensor 21, a storage unit 22, a correction unit 23, a monitoring condition determination unit 24, and an obstacle determination unit 25.

The sensor 21 detects an object around the train 100. Objects include structures such as traffic signals, masts for overhead contact lines, railroad crossings, stations, bridges, and tunnels, which have been installed by the railroad company. Among them, traffic signals, masts for overhead contact lines, and railroad crossings are track-side structures that are each installed alongside a railroad track. Objects also include an obstacle that hinders the operation of the train 100. An obstacle is, for example, an automobile that has entered a railroad track area while a railroad crossing gate is closed, a rockfall from a cliff, a passenger who has fallen from a station platform, a wheelchair in an area of the railroad crossing, or the like. The sensor 21 is an instrument capable of detecting these structures and obstacles, for example, a stereo camera including two or more cameras, a Light Detection And Ranging (LIDAR) device, a Radio Detection And Ranging (RADAR) device, and the like. The sensor 21 may have a configuration with two or more instruments. In the present embodiment, the sensor 21 includes a stereo camera and a LIDAR device. In the sensor 21, the stereo camera and the LIDAR device detect the surroundings of the train 100, generate a range image from the resultant data, and output the generated range image to the correction unit 23 and the obstacle determination unit 25. A range image is a monitoring result obtained by monitoring the surroundings of the train 100 by the sensor 21, and includes one or both of a two-dimensional image and a three-dimensional image including range information. The sensor 21 is installed in the leading car of the train 100. In a case where the train 100 is composed of a plurality of cars, the leading car is changed depending on the traveling direction, and so the sensors 21 are installed in the cars at both ends. For example, in a case where the train 100 is a 10-car train composed of cars No. 1 to No. 10, the car No. 1 or the car No. 10 serves as a leading car depending on the traveling direction. In this case, the sensors 21 are installed in the car No. 1 and the car No. 10 of the train 100. The obstacle detection device 20 uses the sensor 21 installed in the leading car in the traveling direction of the train 100.

The storage unit 22 stores map information including position information of railroad tracks on which the train 100 travels and position information of structures installed by the railroad company. Position information of railroad tracks and structures can be expressed as a distance in kilometers from a position used as a point of origin, expressed in latitude and longitude, expressed by coordinates using three-dimensionally measured point groups, or expressed in other appropriate method, or it may also be expressed using any combination of these methods. In a case where position information of railroad tracks and structures is expressed by three-dimensional coordinate values, for example, map information can be created using a mobile mapping system (MMS) or the like. Structures measured three-dimensionally using the MMS can be expressed by the coordinates of points that constitute each structure, but the coordinates of one of the points that constitute each structure may be used as a representative value. One point $P_i$ that constitutes a three-dimensionally measured structure can be expressed as a three-dimensional coordinate value $P_i$ ($x_i$, $y_i$, $z_i$) with use of the coordinate values of three axes in the x-axis direction, the y-axis direction, and the z-axis direction. The storage unit 22 stores, for example, data on the coordinate values of three axes in the x-axis direction, the y-axis direction, and the z-axis direction as a representative value of each structure. In addition, the storage unit 22 stores, for example, data on the coordinate values of three axes in the x-axis direction, the y-axis direction, and the z-axis direction for a position of each interval defined on the railroad track expressed as a distance in kilometers. With regard to the x-axis direction, the y-axis direction, and the z-axis direction, for example, use can be made of a plane orthogonal coordinate system in which the x and y axes can be represented on the horizontal plane and the z-axis can be represented in a height direction with respect thereto. Alternatively, for example, another coordinate system may be used in which an arbitrary point is set as the origin, and the eastward, northward, and vertically upward directions are set as the x-axis direction, the y-axis direction, and the z-axis direction, respectively with use of the point of origin of a distance in kilometers as the origin. For units of data indicating the coordinate values of each point, meters (m) or the like can be used, but the present invention is not limited thereto. The storage unit 22 can hold the position coordinates of the railroad track expressed by three-dimensional coordinate values by holding the three-dimensional coordinate value for each distance in kilometers on the railroad track, for example, for every one-meter point. In the present embodiment, the storage unit 22 stores position information of railroad tracks and structures in the form of combination of a distance in kilometers and three-dimensional coordinate values. The storage unit 22 may store the map information during a process in which the train 100 travels and/or store the map information that has been measured in advance.

The correction unit 23 acquires, from the train control device 10, train position information indicating the position of the train 100, as described later. The correction unit 23 corrects the train position information of the train 100 acquired from the train control device 10 using the range image acquired from the sensor 21 and the map information stored in the storage unit 22. The correction unit 23 outputs the corrected train position information of the train 100 to the monitoring condition determination unit 24. Note that the train position information of the train 100 that the correction unit 23 acquires from the train control device 10 is referred to as first train position information, and the train position information of the train 100 that is a correction result obtained by the correction unit 23 is referred to as second train position information.

The monitoring condition determination unit 24 determines the monitoring range of the sensor 21 with respect to the traveling direction of the train 100 using the second train position information acquired from the correction unit 23 and the map information stored in the storage unit 22. The monitoring condition in the first embodiment is the monitoring range of the sensor 21.

The obstacle determination unit 25 determines the presence or absence of an obstacle in the traveling direction of the train 100 based on the range image acquired from the sensor 21. When the obstacle determination unit 25 determines that an obstacle is included in the range image, the obstacle determination unit 25 generates obstacle detection information that is information indicating that an obstacle has been detected, and outputs the generated obstacle detection information to the output device 30. The obstacle detection information may be information merely indicating only the fact that an obstacle has been detected, or may include information on the position where the obstacle has been detected.

The train control device 10 detects the position of the train 100 using a beacon installed on the ground, a transponder (not illustrated), a speed generator, and the like mounted on the train 100. The train control device 10 outputs the detected position of the train 100 to the correction unit 23 as first train position information. The method of detecting the position of the train 100 in the train control device 10 is commonly used as in the conventional art. Although the train control device 10 detects the position of the train 100 based on the moving distance on the railroad track from an absolute position indicated by a beacon, the first train position information may contain an error due to the effect of some error in calculating the moving distance, slip and skid caused by wheels (not illustrated) of the train 100, or the like.

In response to acquiring obstacle detection information from the obstacle determination unit 25, the output device 30 outputs information indicating that an obstacle has been detected to a motorman of the train 100 or the like. The output device 30 may display that an obstacle has been detected to the motorman of the train 100 or the like via a monitor or the like, or may output a sound indicating that an obstacle has been detected via a loudspeaker or the like.

Figure 2:
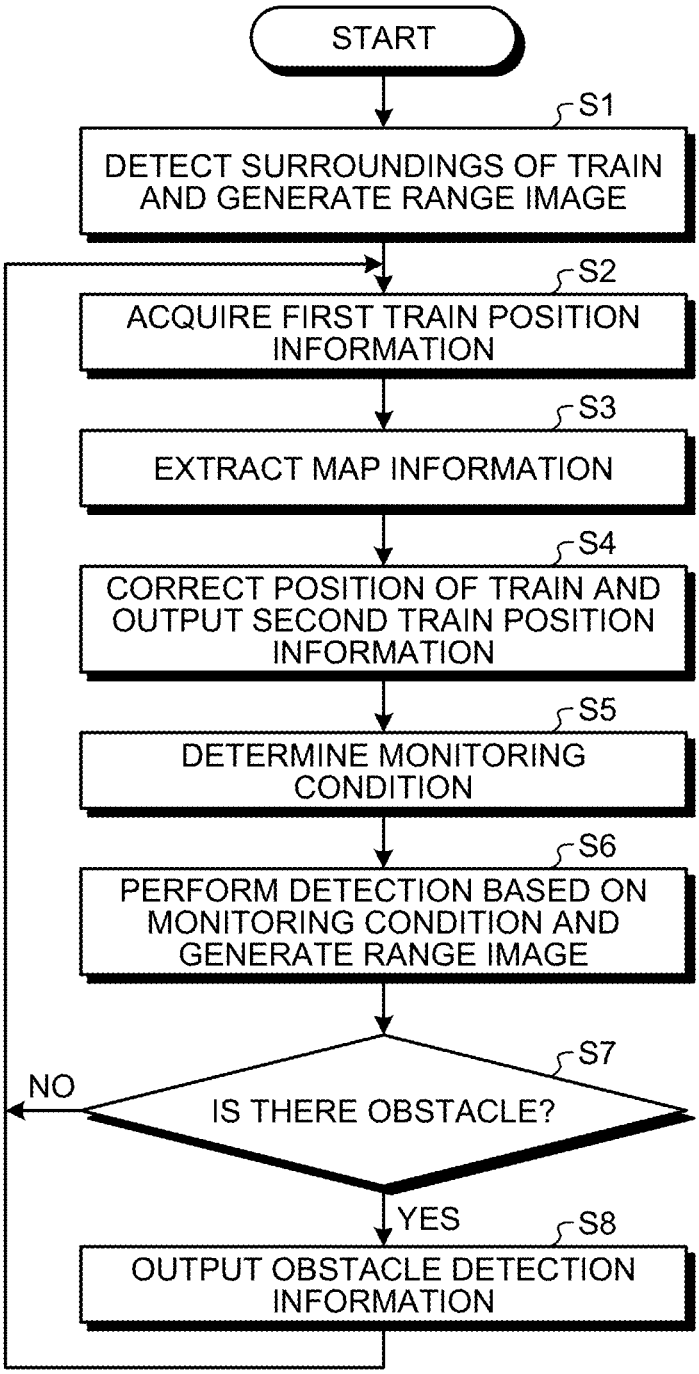
FIG. 2 is a flowchart illustrating an obstacle detection process of the obstacle detection device according to the first embodiment.

Next, an operation of the obstacle detection device 20 detecting an obstacle will be described. FIG. 2 is a flowchart illustrating an obstacle detection process of the obstacle detection device 20 according to the first embodiment. In the obstacle detection device 20, in order to detect an object around the train 100, the sensor 21 detects the surroundings of the train 100 in the traveling direction of the train 100, and generates a range image (step S1). On an initial stage, any monitoring range of the sensor 21 is not determined by the monitoring condition determination unit 24, and therefore the sensor 21 performs detection in a range of −90° to +90° in the horizontal direction with the traveling direction of the train 100 being 0°, or in the maximum range within which monitoring can be realized, and generates a range image. The sensor 21 outputs the generated range image to the correction unit 23. Note that the monitoring range of the sensor 21 is set to extend in the horizontal direction in one example, but may be set to extend in the vertical direction or extend in both the horizontal direction and the vertical direction.

The correction unit 23 acquires the first train position information of the train 100 from the train control device 10 (step S2). The correction unit 23 searches the map information stored in the storage unit 22 based on the first train position information acquired from the train control device 10, and extracts the map information in the monitoring range of the sensor 21, that is, a range included in the range image (step S3). The correction unit 23 may extract the map information in a specified range centered on a position indicated by the first train position information, or may acquire information on the traveling direction of the train 100 from the train control device 10 and extract the map information in a specified range on the traveling direction side of the train 100, specifically, the above-mentioned range of −90° to +90°. The correction unit 23 compares the range image with the extracted map information, and identifies the position of a structure included in the range image. Specifically, the correction unit 23 determines which of the structures in the extracted map information an object included in the range image corresponds to, and selects a position in the map information of a structure in the map information having been determined to correspond to the object, thereby to identify the position of the structure. The correction unit 23 corrects the position of the train 100 based on the identified position of the structure. The structure may be, for example, a track-side structure whose accurate position is possibly known by the railroad company. The correction unit 23 generates second train position information obtained by correcting the position of the train 100 indicated by the first train position information, and outputs the second train position information to the monitoring condition determination unit 24 (step S4).

Figure 3:
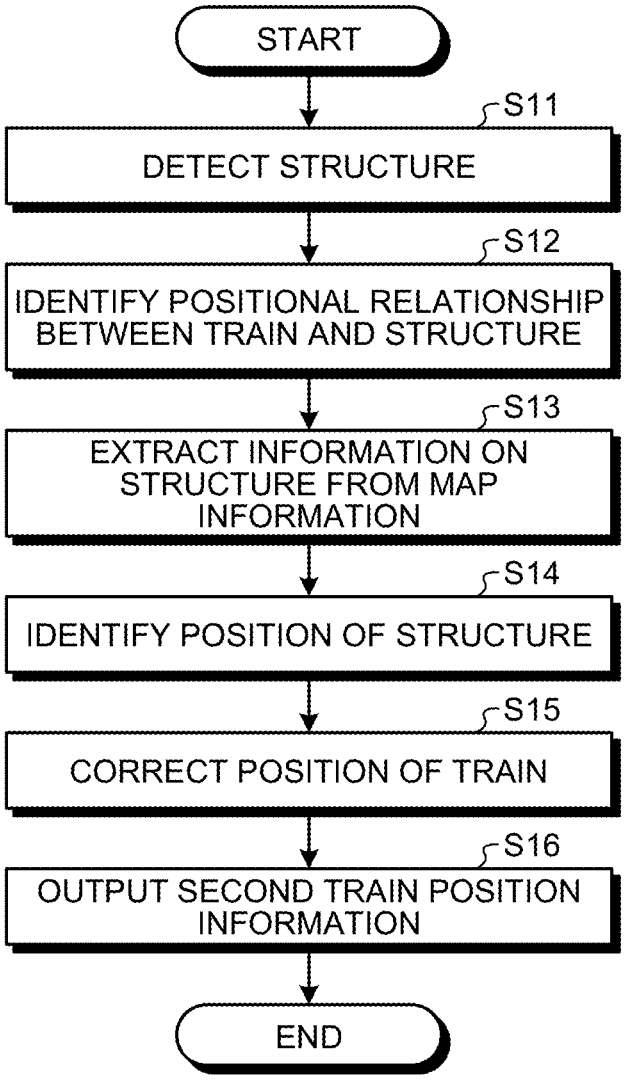
FIG. 3 is a flowchart illustrating a process in which a correction unit according to the first embodiment corrects the position of a train.
Figure 4:
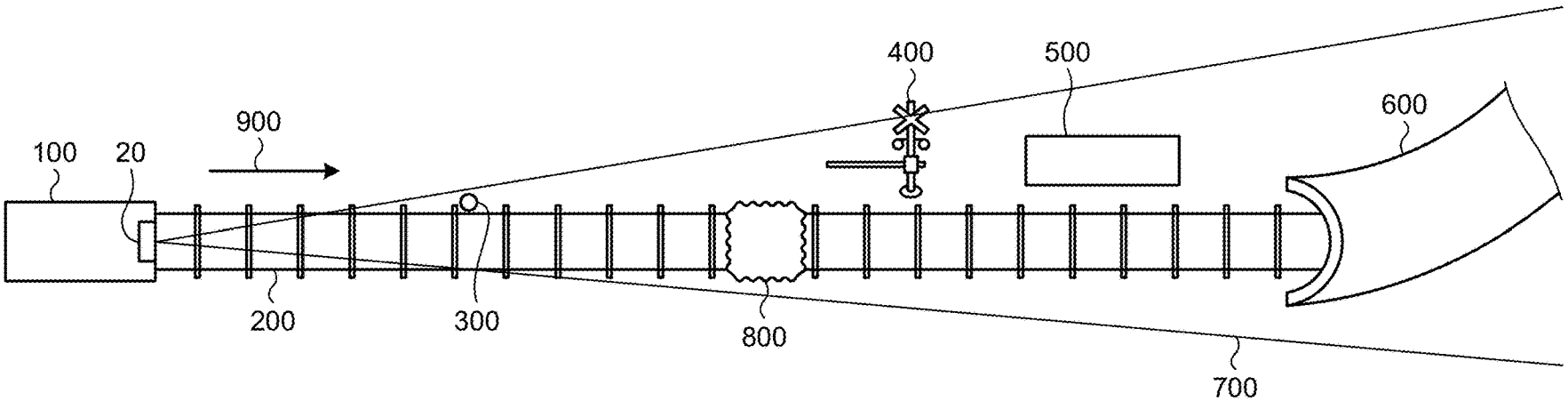
FIG. 4 is a diagram illustrating an example of the monitoring range of the obstacle detection device according to the first embodiment.
Figure 5:
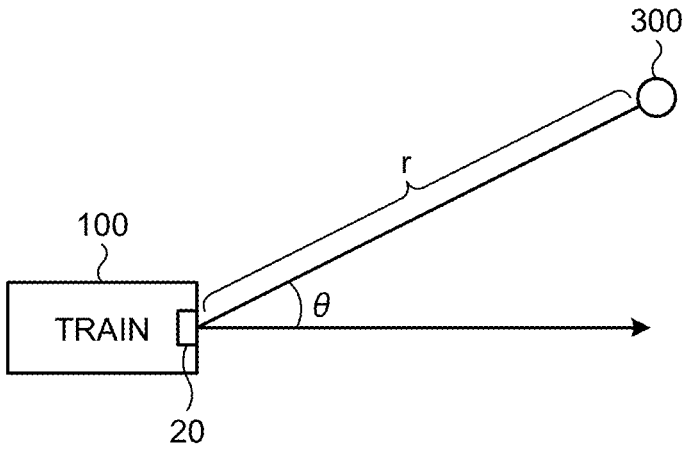
FIG. 5 is a diagram illustrating an example of identifying the positional relationship between a train and a track-side structure in the obstacle detection device according to the first embodiment.

Here, the process of step S4, that is, the process of correcting the position of the train 100 in the correction unit 23 will be described in detail. FIG. 3 is a flowchart illustrating a process in which the correction unit 23 according to the first embodiment corrects the position of the train 100. FIG. 4 is a diagram illustrating an example of the monitoring range of the obstacle detection device 20 according to the first embodiment. FIG. 5 is a diagram illustrating an example of identifying the positional relationship between the train 100 and a track-side structure in the obstacle detection device 20 according to the first embodiment. FIG. 4 shows that, in the traveling direction of the train 100 equipped with the obstacle detection device 20, a traffic signal 300, a railroad crossing 400, and a station 500 are installed alongside a railroad track 200, and a tunnel 600 is built beyond the station 500. A monitoring range 700 represents the monitoring range of the sensor 21, and an obstacle 800 is an obstacle such as a rockfall present on the railroad track 200. In FIG. 4, the traveling direction of the train 100 is a direction indicated by an arrow 900.

The correction unit 23 detects a structure from the range image acquired from the sensor 21 (step S11). Using the range image acquired from the sensor 21, the correction unit 23 can recognize that a structure exists at a certain position even though the type of a structure cannot be identified. In a case where the sensor 21 is a stereo camera and a LIDAR device as described above, the correction unit 23 can recognize that a structure is included in the range image obtained by the sensor 21 using a conventional general method. In a case where track-side structures are targeted as structures, the sensor 21 can easily detect a track-side structure because the track-side structure is a traffic signal, a mast for overhead contact lines, a railroad crossing, or the like. Therefore, it is assumed that the range image includes some track-side structure. When the correction unit 23 detects a plurality of structures from the range image acquired from the sensor 21, the correction unit 23 selects as a target the structure closest to the train 100, for example, from among the structures detected from the range image, and identifies the position of the selected structure.

The correction unit 23 uses the range image acquired from the sensor 21 to identify the positional relationship between the train 100 and the successfully detected structure (step S12). The positional relationship means a relative position between the train 100 and the successfully detected structure. Specifically, the correction unit 23 obtains a distance r and an angle θ in the horizontal direction with respect to the traveling direction from the train 100 to the structure. The correction unit 23 can compute the distance r and the angle θ from the train 100 to the structure using the range image in a conventional general method. The correction unit 23 searches the map information based on the relative position of the structure whose positional relationship has been identified, and extracts information on the structure located around the relative position from the map information (step S13). For example, based on the first train position information and the position information of the railroad track included in the map information, the correction unit 23 converts the position of the train 100 that is based on the first train position information into a three-dimensional coordinate value, and extracts, from the map information, a three-dimensional coordinate value of a point located around the position at the distance r and the angle θ based on the three-dimensional coordinate value of the position of the train 100.

The correction unit 23 identifies the position of the structure whose positional relationship has been identified from the range image by using the position of the structure indicated by the extracted map information (step S14). For example, the correction unit 23 identifies the position of the structure whose positional relationship has been identified from the range image by using the three-dimensional coordinate value of the structure extracted from the map information. In the example of FIG. 4, the traffic signal 300 and the railroad crossing 400 that are track-side structures are provided as structures, and the correction unit 23 identifies the positional relationship of the traffic signal 300 that is closest to the train 100. The accurate position of the traffic signal 300 is recorded in the map information by using a three-dimensional coordinate value. The correction unit 23 identifies the position of a structure whose positional relationship has been identified from the range image, that is, the position of the traffic signal 300 in the example of FIG. 4, using the position of the traffic signal 300 indicated by the map information, that is, the three-dimensional coordinate value thereof.

The correction unit 23 identifies the position of the train 100 based on the identified position of the traffic signal 300, and corrects the position of the train 100 (step S15). Because the correction unit 23 knows the positional relationship between the train 100 and the traffic signal 300 from the distance r and the angle θ, the correction unit 23 fixes the position of the traffic signal 300 at the three-dimensional coordinate value, and corrects the position of the train 100 using the distance r and the angle θ. That is, the correction unit 23 corrects the first train position information. In the example of FIG. 4, a straight line in the opposite direction of the traveling direction of the train 100 is drawn leftward from the traffic signal 300. The corrected train 100 is located at the position of the angle θ and the distance r from the traffic signal 300 with respect to this straight line.

The correction unit 23 sets the corrected position of the train 100 as second train position information, and outputs the second train position information to the monitoring condition determination unit 24 (step S16).

Let us now return to the explanation of the flowchart in FIG. 2. The monitoring condition determination unit 24 determines the monitoring condition of the sensor 21 with respect to the traveling direction of the train 100, that is, the monitoring range 700, using the second train position information acquired from the correction unit 23 and the map information stored in the storage unit 22 (step S5). Because the monitoring condition determination unit 24 can grasp the shape of the railroad track 200 from the position information of the railroad track 200 included in the map information, the monitoring condition determination unit 24 determines the monitoring range 700 of the sensor 21 such that the railroad track 200 in the traveling direction of the train 100 is covered by the range 700. The shape includes the curvature and gradient of the railroad track, the width of the track, and the like. By determining or limiting the monitoring range 700 of the sensor 21 as illustrated in FIG. 4, the monitoring condition determination unit 24 can reduce the amount of calculation for the sensor 21 as compared to the case of step S1. Further, by limiting the monitoring range 700 of the sensor 21, the monitoring condition determination unit 24 can reduce the amount of calculation for the obstacle determination unit 25 as compared to the case of using the range image obtained in step S1.

Here, let us consider the case in which the monitoring condition determination unit 24 determines the monitoring range 700 of the sensor 21 using the first train position information. When the monitoring condition determination unit 24 determines the monitoring range 700 of the sensor 21 with respect to the traveling direction of the train 100 using the first train position information including some error and the map information, the monitoring condition determination unit 24 must determine the monitoring range 700 of the sensor 21 in consideration of the positional error of the train 100. Therefore, the monitoring condition determination unit 24 needs to set a larger monitoring range 700 than when using the second train position information. This is because when the sensor 21 performs long-range monitoring, a slight error in the position of the train 100 leads to a large difference in distance in a faraway place. Especially in a place where the train 100 is approaching a curve or a slope, there is a large difference in distance. In the present embodiment, by using the second train position information in which the position of the train 100 has been corrected, the monitoring condition determination unit 24 can make a monitoring range 700 of the sensor 21 smaller and reduce the amount of calculation for the sensor 21 and the obstacle determination unit 25 as compared to the case of using the first train position information.

The monitoring condition determination unit 24 outputs the determined monitoring condition, that is, information on the monitoring range 700, to the sensor 21. The information on the monitoring range 700 may be, for example, information on the direction and range in which the sensor 21 performs detection, or may be information indicating, by an angle, the range in which the sensor 21 performs detection.

The sensor 21 performs detection based on the monitoring condition acquired from the monitoring condition determination unit 24, that is, the monitoring range 700, and generates a range image (step S6). The sensor 21 outputs the generated range image to the correction unit 23 and the obstacle determination unit 25. The sensor 21 may detect a wide area covering the monitoring range 700 and use only the detection result included in the monitoring range 700.

The obstacle determination unit 25 determines whether or not there is an obstacle, that is, whether or not any obstacle is included in the range image acquired from the sensor 21 (step S7). The obstacle determination unit 25 can determine whether or not any obstacle is included in the range image using the range image acquired from the sensor 21 with a method similar to that in the correction unit 23 described above. If there is an obstacle, that is, if the range image includes an obstacle (step S7: Yes), the obstacle determination unit 25 outputs, to the output device 30, obstacle detection information indicating that an obstacle has been detected (step S8). In response to acquiring the obstacle detection information from the obstacle determination unit 25, the output device 30 outputs, to the motorman or the like, information indicating that an obstacle has been detected in the traveling direction of the train 100.

If there is no obstacle, that is, the range image does not include any obstacle (step S7: No), or after the process of step S8, the obstacle detection device 20 returns to step S2 to repeatedly perform the above-mentioned process. Specifically, the correction unit 23 performs a process of steps S2 to S4 every time a range image generated by the sensor 21 in step S6 is acquired. In step S3, the correction unit 23 may acquire information on the monitoring range 700 from the monitoring condition determination unit 24 and extract the map information within the monitoring range 700. The monitoring condition determination unit 24 performs the process of step S5 every time the second train position information is acquired.

Note that the above-mentioned method of determining whether or not the range image includes an obstacle in the obstacle determination unit 25 is one example, and another method may be used. For example, in a case where the train repeatedly travels on the same route, the obstacle determination unit 25 holds, as a past range image, a range image for the last travel or a range image when no obstacle has been detected. The obstacle determination unit 25 compares the latest range image and the held range image at one and the same train position, and if there is some difference, that is, when an object that is not included in the held range image is detected in the latest range image, the obstacle determination unit 25 determines that the latest distance image includes an obstacle.

Further, when there is an obstacle, the obstacle determination unit 25 may output obstacle detection information to the output device 30 and output a brake instruction for stopping or decelerating the train 100 to the train control device 10. When acquiring the brake instruction from the obstacle determination unit 25, the train control device 10 performs control to stop or decelerate the train 100.

Next, the hardware configuration of the obstacle detection device 20 will be described. In the obstacle detection device 20, the sensor 21 is a stereo camera and a LIDAR device as described above. The storage unit 22 is a memory. The correction unit 23, the monitoring condition determination unit 24, and the obstacle determination unit 25 are implemented by processing circuitry. That is, the obstacle detection device 20 includes a processing circuit that can correct the position of the train 100 and detect an obstacle. The processing circuit may be a memory and a processor that executes a program stored in the memory, or may be of dedicated hardware.

Figure 6:
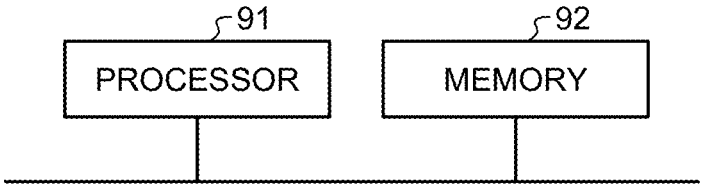
FIG. 6 is a diagram illustrating an example in a case where the processing circuitry owned by the obstacle detection device according to the first embodiment is configured with a processor and a memory.

FIG. 6 is a diagram illustrating an example of a case where the processing circuitry of the obstacle detection device 20 according to the first embodiment is configured with a processor and a memory. In a case where the processing circuitry is configured with the processor 91 and the memory 92, each function of the processing circuitry of the obstacle detection device 20 is implemented by software, firmware, or a combination of software and firmware. Software or firmware is described as a program and stored in the memory 92. In the processing circuitry, the processor 91 reads and executes the program stored in the memory 92, thereby implementing each function. That is, the processing circuitry includes the memory 92 for storing programs that can result in the correction of the position of the train 100 and the detection of an obstacle being realized. It can also be said that these programs correspond to a means to cause a computer to execute the procedures and methods for the obstacle detection device 20.

The processor 91 may be a central processing unit (CPU), a processing device, an arithmetic device, a microprocessor, a microcomputer, or a digital signal processor (DSP). The memory 92 corresponds to a non-volatile or volatile semiconductor memory, a magnetic disk, a flexible disk, an optical disc, a compact disc, a mini disc, a digital versatile disc (DVD), or the like. Examples of the non-volatile or volatile semiconductor memory include a random access memory (RAM), a read only memory (ROM), a flash memory, an erasable programmable ROM (EPROM), an electrically EPROM (EEPROM, registered trademark), and the like.

Figure 7:
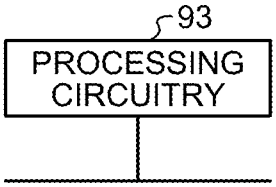
FIG. 7 is a diagram illustrating an example in a case where the processing circuitry owned by the obstacle detection device according to the first embodiment is configured with dedicated hardware.

FIG. 7 is a diagram illustrating an example of a case where the processing circuitry owned by the obstacle detection device 20 according to the first embodiment is configured with dedicated hardware. In a case where the processing circuitry is configured with dedicated hardware, the processing circuitry 93 illustrated in FIG. 7 corresponds, for example, to a single circuit, a composite circuit, a programmed processor, a parallel programmed processor, an application specific integrated circuit (ASIC), a field programmable gate array (FPGA), or any combination thereof. The functions of the obstacle detection device 20 may be implemented by the processing circuitry 93 separately for each function or collectively in whole.

Note that a part of each function of the obstacle detection device 20 may be implemented by dedicated hardware, and the other part thereof may be implemented by software or firmware. In this manner, the processing circuitry can implement the above-described functions using dedicated hardware, software, firmware, or any combination thereof.

As described above, according to the present embodiment, in the obstacle detection device 20, the correction unit 23 corrects the position of the train 100 detected by the train control device 10, and the monitoring condition determination unit 24 determines the monitoring range 700 of the sensor 21 based on the corrected position of the train 100. As a result, the obstacle detection device 20 can limit the monitoring range 700 by accurately identifying the position of the train 100, and thus can detect the obstacle 800 without deteriorating the accuracy while minimizing the amount of calculation.

Second Embodiment

Although the obstacle detection device 20 corrects the position of the train 100 in the first embodiment, the corrected position of the train 100 may not be on the railroad track 200 due to some factor such as the accuracy of the sensor 21. In the second embodiment, the obstacle detection device 20 corrects the position of the train 100 in two steps. The difference from the first embodiment will be described.

Figure 8:
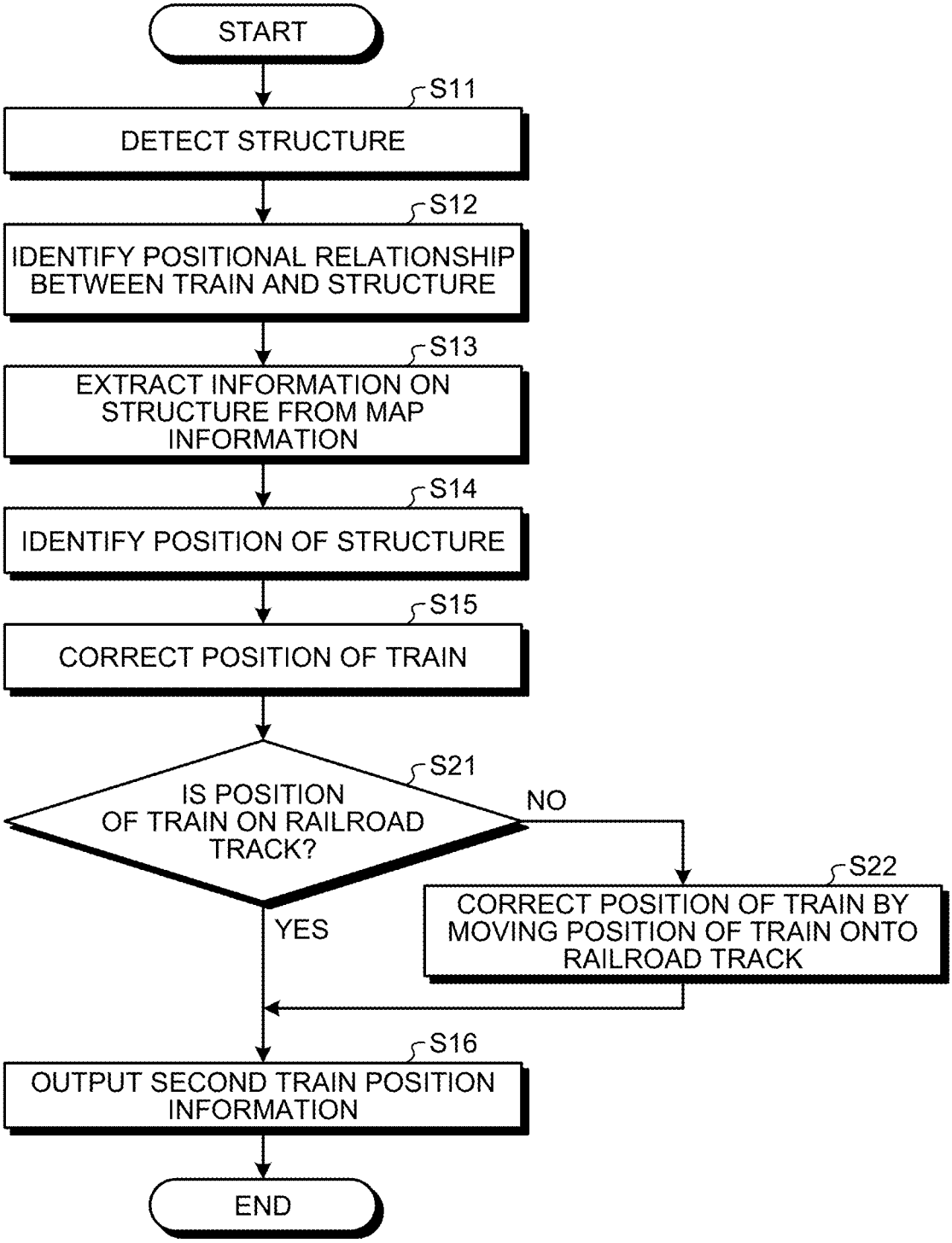
FIG. 8 is a flowchart illustrating a process in which a correction unit according to the second embodiment corrects the position of a train.

The configuration of the obstacle detection device 20 in the second embodiment is similar to the configuration of the obstacle detection device 20 of the first embodiment illustrated in FIG. 1. The obstacle detection process of the obstacle detection device 20 is also similar to the process of the flowchart of the first embodiment illustrated in FIG. 2. The second embodiment is different from the first embodiment in content of the process of step S4 of the flowchart illustrated in FIG. 2, that is, the process of correcting the position of the train 100 in the correction unit 23. FIG. 8 is a flowchart illustrating a process in which the correction unit 23 according to the second embodiment corrects the position of the train 100. The flowchart illustrated in FIG. 8 is obtained by adding the process of steps S21 and S22 to the flowchart of the first embodiment illustrated in FIG. 3.

After the process of step S15, the correction unit 23 determines whether or not the result of correction, that is, the corrected position of the train 100 is on the railroad track 200, based on the position information of the railroad track 200 included in the map information of the storage unit 22 (step S21). If the three-dimensional coordinate value of the corrected position of the train 100 is the same as the three-dimensional coordinate value of any position on the railroad track 200, the correction unit 23 can determine that the corrected position of the train 100 is on the railroad track 200. If the corrected position of the train 100 is not on the railroad track 200 (step S21: No), the correction unit 23 fixes the position of the traffic signal 300 to maintain the relationship of the distance r and the angle θ with respect to the traffic signal 300, and further corrects the position of the train 100 by moving the position of the train 100 onto the railroad track 200 (step S22). For example, the correction unit 23 moves the position of the train 100 by rotating the position of the train 100 around the traffic signal 300. If the corrected position of the train 100 is on the railroad track 200 (step S21: Yes), or after the process of step S22 is performed, the correction unit 23 sets the corrected position of the train 100 on the railroad track 200 as second train position information, and outputs the second train position information to the monitoring condition determination unit 24 (step S16).

As described above, according to the present embodiment, in the obstacle detection device 20, the correction unit 23 is configured to correct the position of the train 100 detected by the train control device 10, and if the corrected position of the train 100 is not on the railroad track 200, further correct the position of the train 100 so that the position is made onto the railroad track 200. As a result, the obstacle detection device 20 can limit the monitoring range 700 by more accurately identifying the position of the train 100 than in the first embodiment, and thus can detect the obstacle 800 without deteriorating the accuracy while minimizing the amount of calculation.

Third Embodiment

In the first embodiment, the obstacle detection device 20 limits the monitoring range 700 of the sensor 21 because the obstacle detection device 20 corrects the position of the train 100 and does not have to consider the positional error of the train 100. In the third embodiment, the obstacle detection device 20 adjusts or determines the monitoring range 700 and the resolution of the sensor 21 based on a structure included in the monitoring range 700. The difference from the first embodiment will be described.

The configurations of the obstacle detection device 20 and the train 100 according to the third embodiment are similar to those of the first embodiment. Herein assumed is that the traveling direction of the train 100 is in the situation illustrated in FIG. 4.

Near the railroad crossing 400 where people, automobiles, and the like cross the railroad track 200, the probability of existence of an object that can obstruct the passage of the train 100 is higher than in a part of the railroad track 200 without being associated with the railroad crossing 400, e.g. a part of the railroad track 200 near the traffic signal 300. For this reason, in a specified range covering the railroad crossing 400, the monitoring condition determination unit 24 determines the monitoring conditions of the sensor 21 to make the monitoring range 700 of the sensor 21 wider and make the resolution of the sensor 21 higher than normal, that is, as compared to a part of the railroad track 200 without being associated with the railroad crossing 400. The monitoring conditions in the third embodiment are the monitoring range 700 of the sensor 21 and the resolution of the sensor 21. A specified range may be set individually depending on the traffic volume of each railroad crossing 400 or the like, or may be set uniformly for all railroad crossings 400. In a case where a specified range is set for the railroad crossing 400 or the like in the third embodiment, the monitoring condition determination unit 24 modifies, according to the specified range, the monitoring range 700 determined in the method of the first embodiment. In addition, there may be a possibility for a passenger to fall from a platform near the station 500. For this reason, in a specified range covering the station 500, the monitoring condition determination unit 24 determines the monitoring conditions of the sensor 21 such that the monitoring range 700 of the sensor 21 is made wider and the resolution of the sensor 21 is made higher than normal, that is, as compared to a part of the railroad track 200 without being associated with the station 500. A specified range may be set individually depending on the number of passengers at each station 500 or the like, or may be set uniformly for all stations 500. The monitoring condition determination unit 24 can increase the resolution of the sensor 21, for example, by determining the monitoring condition of the sensor 21 such that the spatial resolution of the sensor 21 is made shorter than normal or the sampling rate of the sensor 21 is made higher than normal. "Normal" or a normal time means a situation in which the sensor 21 performs detection near the traffic signal 300, for example. The sensor 21 can detect a smaller obstacle 800 with its resolution increasing.

The sensor 21 requires a larger amount of calculation when performing detection near the railroad crossing 400 or near the station 500 than when performing detection in a part of the railroad track 200 without being associated with the railroad crossing 400 or the station 500. However, depending on the settings of the monitoring range 700 and the resolution of the sensor 21 realized by the monitoring condition determination unit 24, it can be expected for the sensor 21 to have a smaller amount of calculation than in step S1 of the flowchart illustrated in FIG. 2 of the first embodiment. Similarly, the obstacle determination unit 25 can also be expected to have a smaller amount of calculation.

On the other hand, in the tunnel 600 where the railroad track 200 is enclosed in a closed space, the probability of existence of an object that can obstruct the passage of the train 100 is lower than in a part of the railroad track 200 without being associated with the tunnel 600, e.g. a part of the railroad track 200 near the traffic signal 300. For this reason, in a specified range covering the tunnel 600, the monitoring condition determination unit 24 determines the monitoring conditions of the sensor 21 such that the monitoring range 700 of the sensor 21 is made narrower and the resolution of the sensor 21 is made lower than at a normal time, that is, as compared to a part of the railroad track 200 without being associated with the tunnel 600. A specified range may be set individually for each tunnel 600, or may be set uniformly for all tunnels 600. The monitoring condition determination unit 24 can make the resolution of the sensor 21 lower, for example, by determining the monitoring condition of the sensor 21 so as to make the spatial resolution of the sensor 21 coarser than normal or make the sampling rate of the sensor 21 lower than normal.

The sensor 21 can have a much smaller amount of calculation when performing detection in the tunnel 600 than when performing detection in a part of the railroad track 200 without being associated with the tunnel 600. Similarly, the obstacle determination unit 25 can also have a much smaller amount of calculation in that case.

The monitoring condition determination unit 24 may adjust the resolution of the sensor 21 regardless of the situation for the traveling direction of the train 100. For example, the monitoring condition determination unit 24 may increase the resolution of the sensor 21 when the monitoring range 700 of the sensor 21 can be made narrower than a specified first range. The amount of calculation of the sensor 21 increases as the resolution becomes higher, but if the amount of increase for the amount of calculation is smaller than the amount of decrease for the amount of calculation caused by limiting the monitoring range 700, the resolution of the sensor 21 can be improved while the amount of calculation of the sensor 21 is reduced, so that a smaller obstacle can be detected. Alternatively, the monitoring condition determination unit 24 may reduce the resolution of the sensor 21 when the monitoring range 700 of the sensor 21 becomes wider than a specified second range.

As described above, according to the present embodiment, in the obstacle detection device 20, the monitoring condition determination unit 24 is adapted to adjust the resolution of the sensor 21 according to the situation for the traveling direction of the train 100. As a result, the obstacle detection device 20 can increase the resolution of the sensor 21 or further reduce the amount of calculation of the sensor 21 according to the situation for the traveling direction of the train 100.

The configurations described in the above-mentioned embodiments correspond to examples of the contents of the present invention, and can be combined with other publicly known techniques and partially omitted and/or modified without departing from the scope of the present invention.

REFERENCE SIGNS LIST

10 train control device; 20 obstacle detection device; 21 sensor; 22 storage unit; 23 correction unit; 24 monitoring condition determination unit; 25 obstacle determination unit; 30 output device; 100 train; 200 railroad track; 300 traffic signal; 400 railroad crossing; 500 station; 600 tunnel; 700 monitoring range; 800 obstacle.

The invention claimed is:

1. An obstacle detection device installed in a train, the obstacle detection device comprising:

a sensor to monitor surroundings of the train and generate a range image that is a result of monitoring;

a storage unit to store map information including position information of structures installed along a railroad track on which the train travels;

a correction unit to correct, using the range image acquired from the sensor and the map information stored in the storage unit, first train position information that is information acquired from a train control device and indicates a position of the train, and to output second train position information that is a result of correction; and a monitoring condition determination unit to determine a monitoring range of the sensor using the second train position information and the map information.

2. The obstacle detection device according to claim 1, wherein the correction unit detects a structure installed alongside the railroad track from the range image, identifies a relative position between the train and the structure detected, identifies a position of the structure based on the position information of structures included in the map information, and identifies the position of the train based on the relative position to correct the first train position information.

3. The obstacle detection device according to claim 2, wherein the storage unit further stores position information of the railroad track, and the correction unit determines, based on the position information of the railroad track included in the map information, whether or not the position of the train indicated by the result of correction of the first train position information is on the railroad track, sets the result of correction as the second train position information when the position of the train is on the railroad track in the determination, but further moves the position of the train indicated by the result of correction of the first train position information onto the railroad track to set the position moved onto the railroad track as the second train position information when the position of the train is not on the railroad track in the determination.

4. The obstacle detection device according to claim 1, wherein the monitoring condition determination unit determines the monitoring range of the sensor and a resolution of the sensor based on a structure included in the monitoring range.

5. The obstacle detection device according to claim 4, wherein when a railroad crossing is included in the monitoring range of the sensor, the monitoring condition determination unit makes the monitoring range wider than normal and makes the resolution higher than normal in a specified range including the railroad crossing, when a station is included in the monitoring range of the sensor, the monitoring condition determination unit makes the monitoring range wider than normal and makes the resolution higher than normal in a specified range including the station, and when a tunnel is included in the monitoring range of the sensor, the monitoring condition determination unit makes the monitoring range narrower than normal and makes the resolution lower than normal in a specified range including the tunnel.

6. The obstacle detection device according to claim 1, comprising an obstacle determination unit to determine presence or absence of an obstacle based on the range image acquired from the sensor, wherein when determining that the range image includes an obstacle, the obstacle determination unit outputs information indicating that the obstacle has been detected.

7. The obstacle detection device according to claim 1, comprising an obstacle determination unit to determine presence or absence of an obstacle based on the range image acquired from the sensor, wherein when determining that the range image includes an obstacle, the obstacle determination unit outputs a brake instruction to the train control device.

8. An obstacle detection method for an obstacle detection device installed in a train, the train including a storage unit to store map information including position information of structures installed along a railroad track on which the train travels, the obstacle detection method comprising:

a monitoring step for a sensor to monitor surroundings of the train and generate a range image that is a result of monitoring;

a correction step for a correction unit to correct, using the range image acquired from the sensor and the map information stored in the storage unit, first train position information that is information acquired from a train control device and indicates a position of the train, and to output second train position information that is a result of correction; and a monitoring condition determination step for a monitoring condition determination unit to determine a monitoring range of the sensor using the second train position information and the map information.

9. The obstacle detection method according to claim 8, wherein in the correction step, the correction unit detects a structure installed alongside the railroad track from the range image, identifies a relative position between the train and the structure detected, identifies a position of the structure based on the position information of structures included in the map information, and identifies the position of the train based on the relative position to correct the first train position information.

10. The obstacle detection method according to claim 9, wherein the storage unit further stores position information of the railroad track, and in the correction step, the correction unit determines, based on the position information of the railroad track included in the map information, whether or not the position of the train indicated by the result of correction of the first train position information is on the railroad track, sets the result of correction as the second train position information when the position is on the railroad track in the determination, but further moves the position of the train indicated by the result of correction of the first train position information onto the railroad track to set the position moved onto the railroad track as the second train position information when the position is not on the railroad track in the determination.

11. The obstacle detection method according to claim 8, wherein in the monitoring condition determination step, the monitoring condition determination unit determines the monitoring range of the sensor and a resolution of the sensor based on a structure included in the monitoring range.

12. The obstacle detection method according to claim 11, wherein in the monitoring condition determination step, when a railroad crossing is included in the monitoring range of the sensor, the monitoring condition determination unit makes the monitoring range wider than normal and makes the resolution higher than normal in a specified range including the railroad crossing, when a station is included in the monitoring range of the sensor, the monitoring condition determination unit makes the monitoring range wider than normal and makes the resolution higher than normal in a specified range including the station, and when a tunnel is included in the monitoring range of the sensor, the monitoring condition determination unit makes the monitoring range narrower than normal and makes the resolution lower than normal in a specified range including the tunnel.

13. The obstacle detection method according to claim 8, comprising an obstacle detection step for an obstacle determination unit to determine presence or absence of an obstacle based on the range image acquired from the sensor, wherein in the obstacle determination step, when determining that the range image includes an obstacle, the obstacle determination unit outputs information indicating that the obstacle has been detected.

14. The obstacle detection method according to claim 8, comprising an obstacle detection step for an obstacle determination unit to determine presence or absence of an obstacle based on the range image acquired from the sensor, wherein in the obstacle detection step, when determining that the distance image includes an obstacle, the obstacle determination unit outputs a brake instruction to the train control device.

* * * * *